United States Patent [19]

Beck

[11] 4,346,770

[45] Aug. 31, 1982

[54] HYDRAULIC JARRING TOOL

[75] Inventor: Harold K. Beck, Duncan, Okla.

[73] Assignee: Halliburton Company, Duncan, Okla.

[21] Appl. No.: 196,405

[22] Filed: Oct. 14, 1980

[51] Int. Cl.[3] ..... E21B 4/14; E21B 31/107

[52] U.S. Cl. ..... 175/297; 166/178

[58] Field of Search ..... 175/297, 296; 166/178, 166/301, 91

[56] References Cited

U.S. PATENT DOCUMENTS

| | | | |
|---|---|---|---|
| 3,209,843 | 10/1965 | Webb | 175/297 |
| 3,285,353 | 11/1966 | Young | 175/297 |
| 3,399,740 | 9/1968 | Barrington | 175/297 |
| 3,429,389 | 2/1969 | Barrington | 175/297 |
| 3,955,634 | 5/1976 | Slator et al. | 175/297 |
| 4,023,630 | 5/1977 | Perkin et al. | 175/297 |
| 4,098,338 | 7/1978 | Perkins | 166/301 |
| 4,161,224 | 7/1979 | Hostrup | 175/297 |
| 4,196,782 | 4/1980 | Blanton | 175/297 |
| 4,200,158 | 4/1980 | Perkins | 175/297 |

*Primary Examiner*—Stephen J. Novosad

*Attorney, Agent, or Firm*—Joseph A. Walkowski; John H. Tregoning

[57] ABSTRACT

A hydraulic well jar of the type having a longitudinally slidable inner mandrel within an outer case, the inner mandrel having a hammer element threon which impacts on an anvil element in the case. Hydraulic fluid is disposed between the case and mandrel. Initial movement of the mandrel with respect to the case is impeded by a hydraulic fluid metering jet mechanism, which is bypassed as the mandrel reaches a predetermined point in its travel, allowing a sudden, more rapid movement of the mandrel, thereby generating a greater impact force. The present invention comprises an improved fluid bypass design, as well as an improved mounting system for the hydraulic fluid screen and jet of the metering mechanism. An improved seal arrangement between the metering mechanism, which is attached to the mandrel and the interior of the outer case provides greater seal life and better performance for the jar.

19 Claims, 13 Drawing Figures

HYDRAULIC JARRING TOOL

BACKGROUND OF THE INVENTION

In many operations conducted in petroleum wells, an operator employs different tools or other articles which do not move readily through the well bore. This problem of movement is compounded in deviated holes, where the weight of a tool string combined with the angle of the well bore contributes to the problem. In some instances, the string becomes stuck in the well bore and further operations are impossible until the string is freed. Jarring tools, or "jars," are commonly employed in strings to help free a string should it become stuck.

Hydraulic jars, such as are disclosed in U.S. Pat. Nos. 3,399,740 and 3,429,389, issued to Burchus Q. Barrington and assigned to the assignee of the present application, have been employed for some time. In general, such jars employ a mandrel within an outer case, there being a hydraulic fluid in several communicating reservoirs between the two. When a pulling force is applied to the mandrel, hydraulic fluid moves between reservoirs in a highly impeded manner, thus inhibiting mandrel movement. When the mandrel travel reaches a certain point, the impedance is bypassed, resulting in a sudden, forceful movement of the mandrel with respect to the case. A hammer element on the mandrel then impacts on an anvil element in the case, producing a substantial jarring force in the string. Repeated reciprocation of the mandrel with respect to the case is generally sufficient to free the string in the well bore. These prior art jars, however, possess a number of disadvantages. They are incapable of numerous repetitions without replacement of parts and reassembly termed "redressing." Furthermore, the jars may be affected adversely by well bore fluids infiltrating the hydraulic fluid. Moreover, the force of impact obtained with these jars is inconsistent over a number of repetitions. Additionally, no slidable elastomeric seal is employed between the mandrel and outer case, a desirable feature which allows greater pressure buildup prior to bypassing, but which cannot be employed successfully due to the structuring of the bypass area, which would promote seal destruction. Finally, the disclosed jars cannot be redressed in the field, but must be taken to a shop facility.

U.S. Pat. No. 4,196,782, issued Apr. 8, 1980 and assigned to Dresser Industries, Inc. discloses another hydraulic jar of the type discussed above, which employs a vortex jet metering element to initially impede the flow of hydraulic fluid. While such a vortex jet element provides somewhat more consistency of fluid flow, the manner in which the jet is mounted in the assembly leaves much to be desired, as there is no screening assembly to prevent particulate matter in the hydraulic fluid from clogging the jet and the jet appears to be mounted with adhesive, which can clog the jet during assembly of the tool. Furthermore, the bypass for the hydraulic fluid is merely an enlarged bore in the case, again preventing the use of a sliding elastomeric seal between the mandrel and case due to deterioration caused by the force of the bypassing hydraulic fluid and return action of the mandrel. An interference fit to provide the mandrel-case seal is called for, but it is readily apparent that such a fit would deteriorate due to wear after several reciprocations of the jar, thus allowing leakage past the metering jet and preventing the necessary high pressure buildup prior to bypassing, which pressure buildup results in the required large force during the subsequent bypassing movement of the mandrel.

U.S. Pat. Nos. 4,023,630, and 4,200,158 each disclose hydraulic jars of a relatively complex structure seeking precision performance, but at the expense of longterm reliability and repeatability due to the large number of individual elements and seals employed. Moreover, the complexity of these jars prohibits easy field maintenance and reassembly.

SUMMARY OF THE INVENTION

The present invention comprises an improved hydraulic well jar of the type which employs a vortex jet hydraulic fluid metering assembly. The hydraulic fluid bypass between the mandrel and case comprises longitudinally extending semi-circular splines rather than a mere enlargement of the case bore. The vortex jet metering assembly employs a mechanical mounting system for the vortex jet and an associated screen, which avoids the need for adhesive in assembly. Furthermore, a novel seal arrangement is employed at the metering assembly between the mandrel and case which arrangement provides a much greater seal life than previously possible. In addition, this seal arrangement ensures operation of the tool even in the event of destruction of the elastomeric seal portion, or of loss of hydraulic fluid. While providing the above-enumerated significant advantages, the jar of the present invention employs a relatively uncomplicated design which facilitates longterm durability and repeatability of results.

BRIEF DESCRIPTION OF THE DRAWINGS

The present invention may be better understood with reference to the disclosure following hereafter, in conjunction with the attached drawings wherein.

DETAILED DESCRIPTION OF THE PREFERRED EMBODIMENT

Referring to FIGS. 1A–1E, 4 and 5, the hydraulic well jar 10 of the present invention comprises outer case 12, within which is slidably disposed mandrel assembly 90. The area between outer case 12 and mandrel assembly 90 is filled with hydraulic fluid, such as DC-200 silicone oil.

Figure 5:
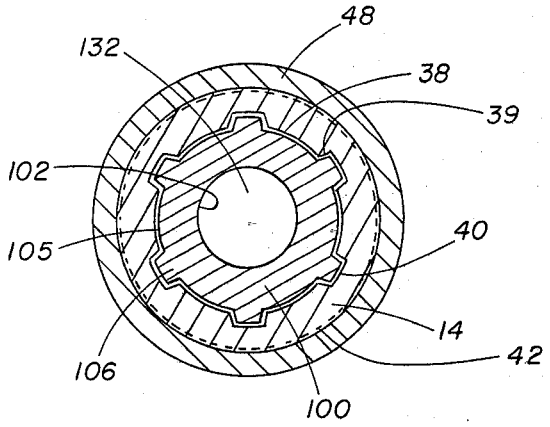
FIG. 5 is a radial cross-section taken along line 5—5 of FIG. 1.

Outer case 12 comprises splined housing 14 having an upper bore, the wall of which is noted at 28. Annular recess 16 in bore wall 28 houses O-ring 18, below which extended upper annular recess 20 houses four O-rings 22, and extended lower annular recess 24 houses four O-rings 26. At the lower extremity of upper bore wall 28 is upper reservoir chamber 30, the area of which 32 adjacent bore wall 28 is of reduced diameter. Filling aperture 34, the outer extent of which is threaded, communicates between the exterior of splined housing 14 and upper reservoir at area 32. Fluid plug 36, having an O-ring thereon, is threaded into filling aperture 34. Below upper reservoir chamber 30, splined housing 14 possesses a plurality of longitudinally extending splines 40, defined by walls 39 and terminating at edges 38, which define the innermost diameter of the splined area. As can be seen in FIG. 5, the preferred embodiment of the invention employs six equally radially spaced splines. The disclosed arrangement is by way of illustration and not by way of limitation.

Splined housing 14 is threaded at 42 to upper case 48, a seal between the two components being effected by O-rings 44. The lower end of splined housing 14 comprises a beveled annular surface, denoted as anvil element 46. Upper case 48 possesses an initial inner diameter 49, defining intermediate reservoir chamber 50, which terminates at its lower end at annular shoulder 52, leading to reduced inner diameter 53. Lower case 58 is threaded at 54 to upper case 48, a seal therebetween being effected by O-rings 56. Lower case 58 defines metering chamber 60 of diameter 61, the upper end of which possesses longitudinal bypass splines 62 of semicircular cross-section. As may be seen in FIG. 4, four bypass splines are employed in the preferred embodiment of the invention, such disclosure being by way of illustration and not limitation. Filling aperture 63 in the wall of lower case 58 is closed by bottom fluid plug 64. Lower case 58 is threaded at 68 to bottom nipple 70, a seal therebetween being effected by O-ring 72. Bottom nipple 70 is of uniform inner diameter 74 to inwardly chamfered shoulder 76, which leads to area 78 of reduced diameter, defining bore 134. Area 78 leads to outwardly chamfered annular surface 80. Threads 82 on the exterior of bottom nipple 70 are employed to connect well jar 10 to pipe or other tools or articles in the string of which well jar 10 is a part, O-ring 84 being used to seal between well jar 10 and the next lower string component.

Mandrel assembly 90, which is longitudinally slidably disposed within outer case 12, comprises top coupling 92, having internal threads 94 at its uppermost extent for connecting well jar 10 to other tools or pipe above it in the string. Top coupling 92 is threaded at 98 into abutting relationship at 97 with impact mandrel 100, a seal between the two components being effected by O-ring 95. Impact mandrel 100 possesses a uniform bore 102, which is substantially the same diameter as that of bore 96 of top coupling 92. Impact mandrel 100 possesses substantially uniform outer surface 104 from its upper extremity to area 105, which is of reduced diameter. Surface 104 is of only slightly less diameter than inner surface 28 of splined housing 14, so that a seal therebetween is achieved with O-rings 18, 22 and 26. Extending from surface 105 of reduced diameter are longitudinal keys 106, which are aligned with splines 40 in splined housing 14. The outermost diameter of keys 106, of which a plurality of six is shown in FIG. 4 by way of illustration, is slightly less than that of splines 40. Below keys 106 is located annular hammer element 108 having leading surface 110, which is beveled at substantially the same angle as anvil element 46. The lower edge of hammer element 10 extends uniformly to the lower end of impact mandrel 100. An annular gap 113 exists between outer surface 112 on impact mandrel 100, and inner surface 53 on upper case 48. Lower mandrel 120 is threaded to impact mandrel 100 at 116, a seal therebetween being effected by O-rings 114. The upper surface 119 of lower mandrel 120 is of reduced diameter in comparison with surface 112 on impact mandrel 100, and with lower surface 126 on lower mandrel 120. Metering cartridge assembly 200 is mounted in this reduced diameter area, and maintained in position between lower end 118 of impact mandrel 100 and radial shoulder 124 of lower mandrel 100 in a manner to be more fully described hereafter with reference to FIG. 3. Lower surface 126 of lower mandrel 120 is of substantially uniform diameter, slightly less than inner diameter 74 of bottom nipple 70, so as to leave annular gap 74 therebetween. A longitudinally short area 128 at the lowest extent of lower mandrel 120, stepped from lower surface 126, terminates at radially flat end surface 130. Bore 132 of uniform diameter extends through both lower mandrel 120 and impact mandrel 100, and communicates with bore 134 through bottom nipple 70.

Equalizing piston 140 is slidably disposed on lower surface 126 of lower mandrel 120, lower reservoir chamber 142 being on its longitudinally upper side, and equalizing chamber 144 being on its longitudinally lower side. Equalizing chamber 144 communicates with bores 132 and 134, and hence the ambient pressure in the string, through annular gap 127.

Figure 3:
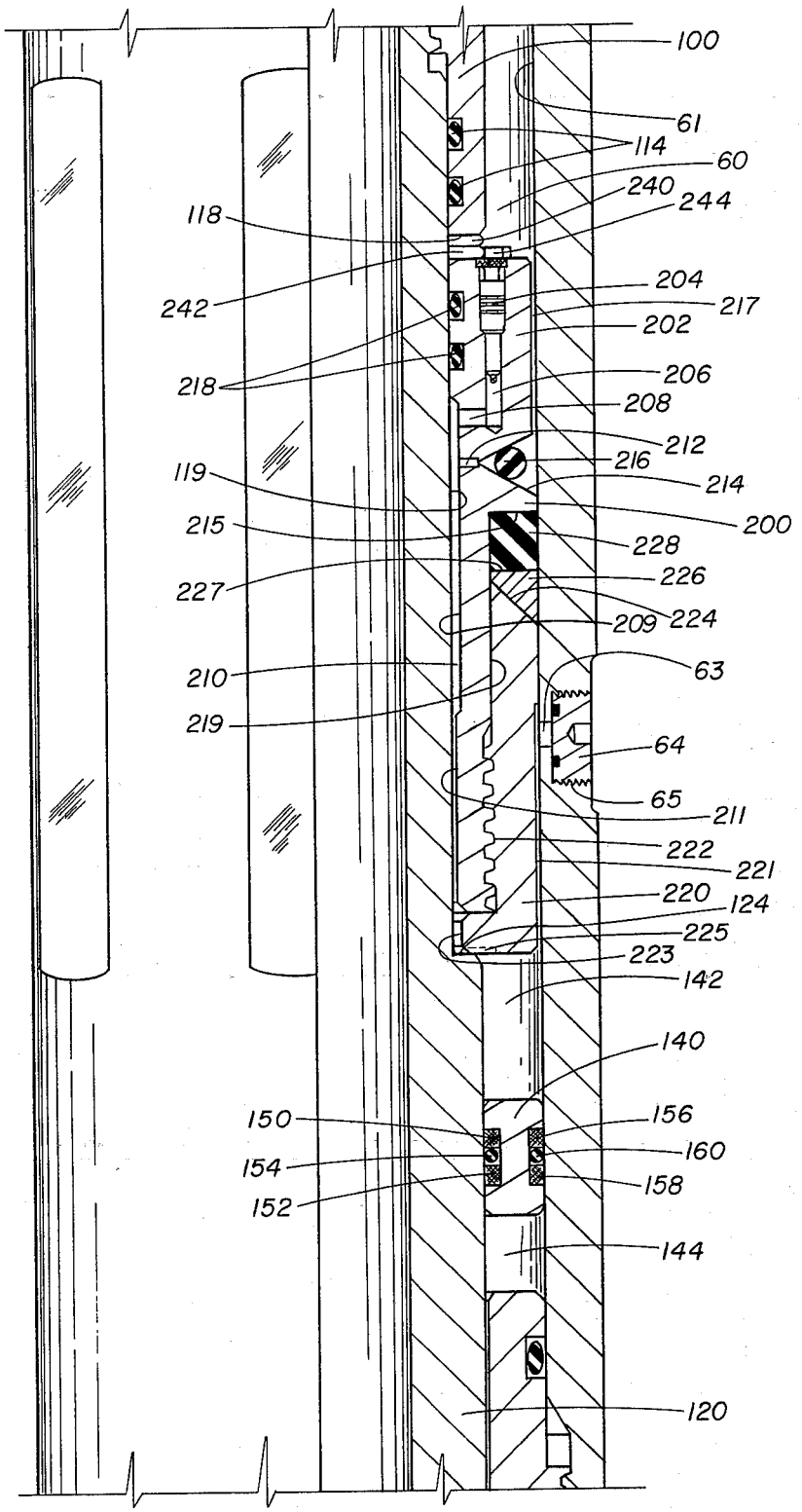
FIG. 3 is an enlarged half-section elevation of the hydraulic metering assembly employed in the present invention.
Figure 4:
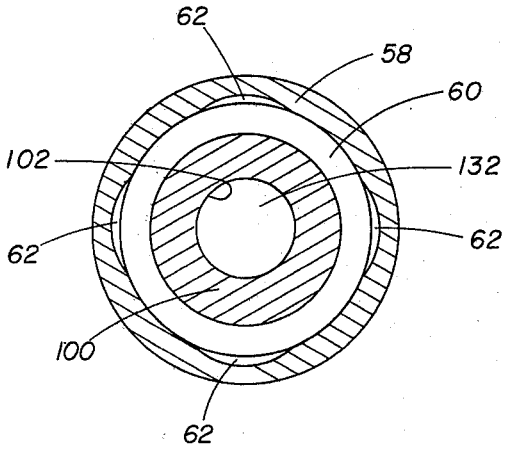
FIG. 4 is a radial cross-section taken along line 4—4 of FIG. 1.

Referring now to FIG. 3, the metering assembly 200 and surrounding components of jar 10 will be described in greater detail. As noted previously, metering assembly is held between lower end 118 of impact mandrel 100 and radial shoulder 124 of lower mandrel 120 on surface 119 of lower mandrel 120. A seal between metering assembly 200 and lower mandrel 120 is effected by O-rings 218. Metering assembly 200 comprises metering cartridge body 202, within which is disposed metering jet 204, a vortex jet such as is manufactured by the Lee Company, 2 Pettipaug Road, Westbrook, Connecticut known as the LEE VISCO JET and described in U.S. Pat. No. 3,323,550. While one metering jet 204 is shown, it should be understood that a plurality may be employed, and that the preferred embodiment of the present invention utilizes two such jets, mounted diametrically opposite each other in metering cartridge body 202. The metering jet 204 extends into longitudinal passage 206 in metering cartridge body 202, which in turn communicates with radial passage 208 which leads to undercut area 209 on cartridge body 202, a longitudinally-extending annular passage 210 being created thereby between lower mandrel 120 at surface 119 and undercut area 209. Annular passage 210 communicates with restricted annular passage 211. Radial passage 212 extends from annular passage 210 to annular V-notch 214, within which is disposed O-ring 216. V-notch 214 communicates with the area above it via annular gap 217. Seal 228 of square cross-section is mounted upon outer surface 219 of metering cartridge body 202 abutting radial face 215. The lower extent of seal 228 abuts radial face 227 of metallic backup ring 226, which is of substantially triangular cross-section. Backup ring 226, which may be of brass, is in turn abutted by the outwardly-beveled surface 224 of seal retainer 220, which is threaded to metering cartridge body 202 at 222. Inner diameter 223 of seal retainer 220 provides an annular gap contiguous with restricted annular passage 211, which communicates with radial channel 225 in the lower end of seal retainer 220. Thus it is apparent that fluid may pass from intermediate reservoir chamber 60 through metering jet 204, through radial passage 208, annular passage 210, restricted annular passage 211, to the annular gap and radial channel 225 in the lower end of seal retainer 220, and subsequently to lower reservoir chamber 142. The lower outer radial extent of seal retainer 220 is of reduced diameter 221 to provide an annular passage for the filling of fluid receiving chamber 142 through aperture 63 when jar 10 is in its retracted position. Metering cartridge assembly is mechanically mounted on lower mandrel 120 through the biasing action of belleville spring 240. Adjacent spring 240 is screen retainer 242 having aperture 244 therethrough, communicating with a screen (shown unnumbered) at the entry port of metering jet 204. As the metering assembly 200 is held between impact mandrel 100 and lower mandrel 120, the biasing action of spring 240 not only provides a positive mechanical mounting for both the metering assembly as a whole and also for the metering jet screen, but completely avoids the use of adhesives in both jet and screen mounting, which adhesives not only deteriorate after a protracted period of time, but can cause clogging of the jet if excess adhesive is employed during assembly.

Figure 1A:
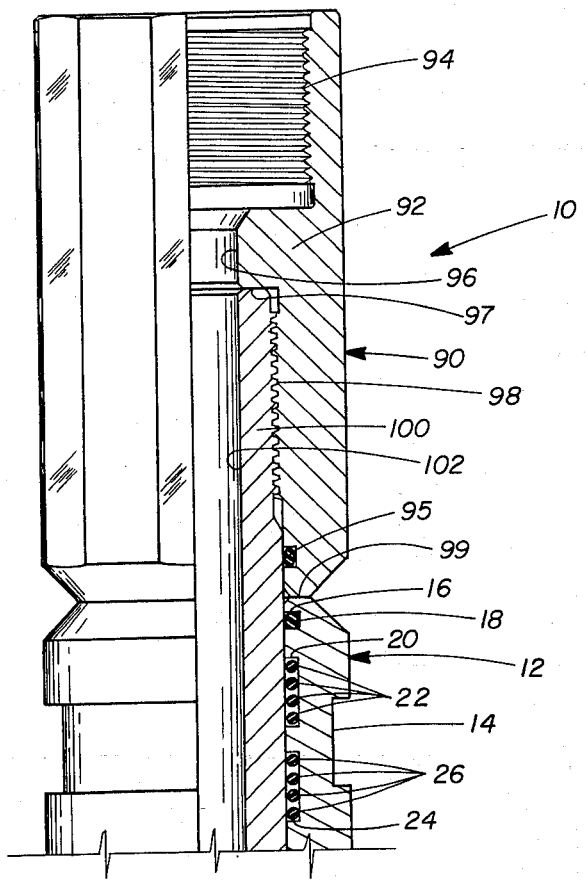
FIGS. 1A–1E are a half-section elevation of the hydraulic well jar of the present invention in its retracted position.
Figure 1B:
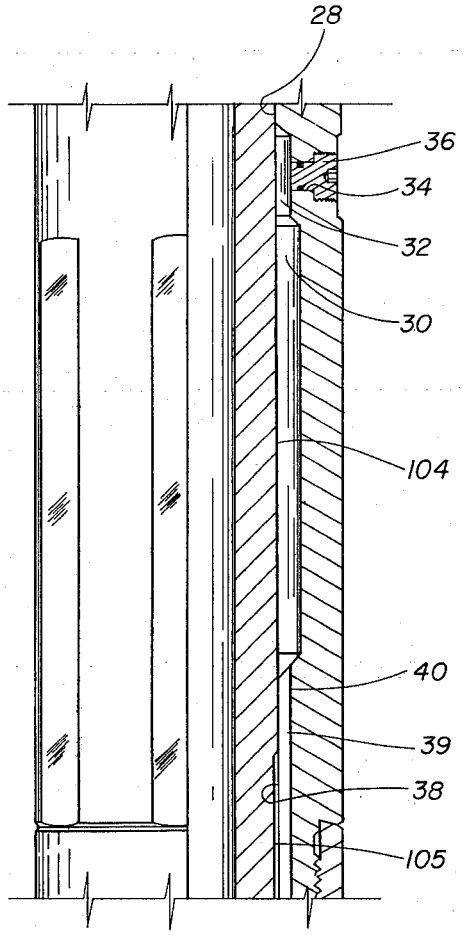
Figure 1C:
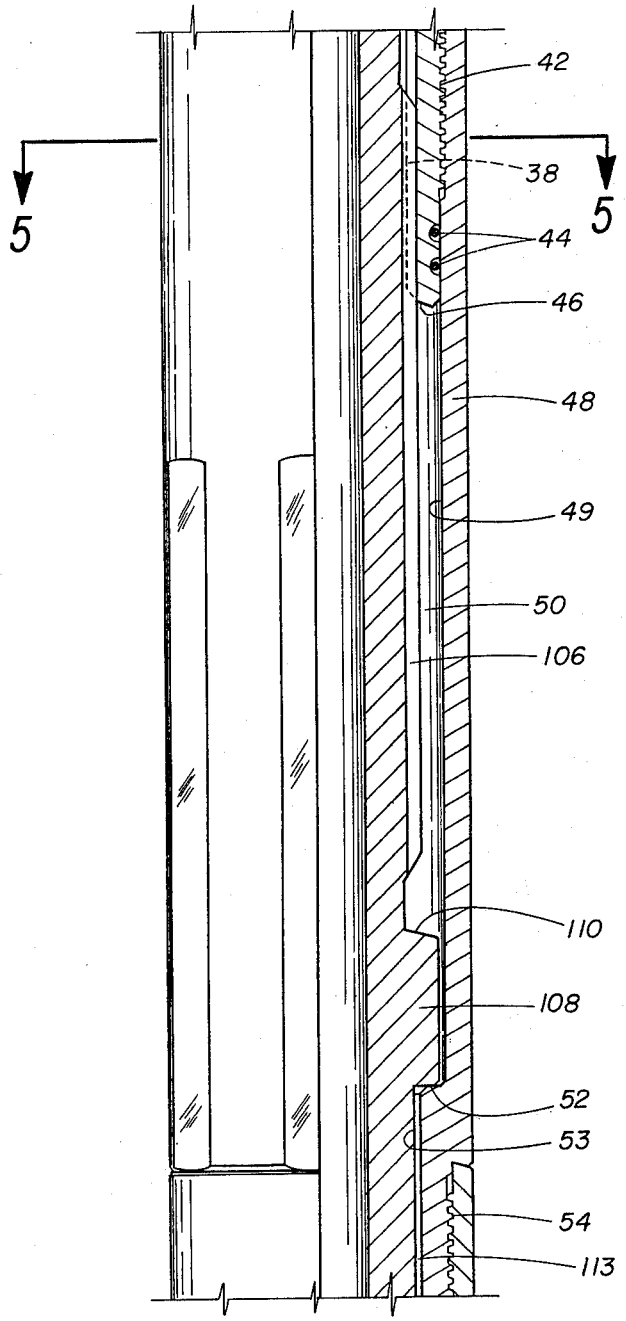
Figure 1D:
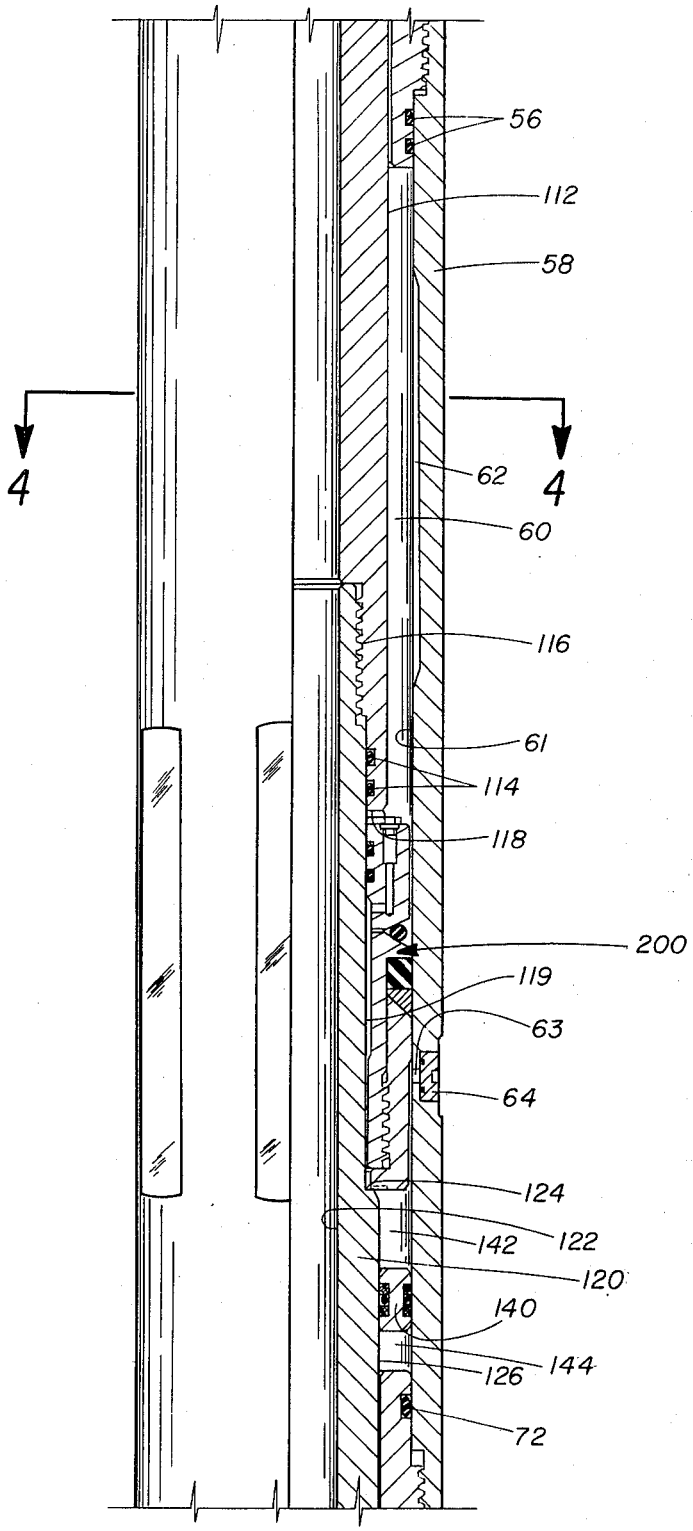
Figure 1E:
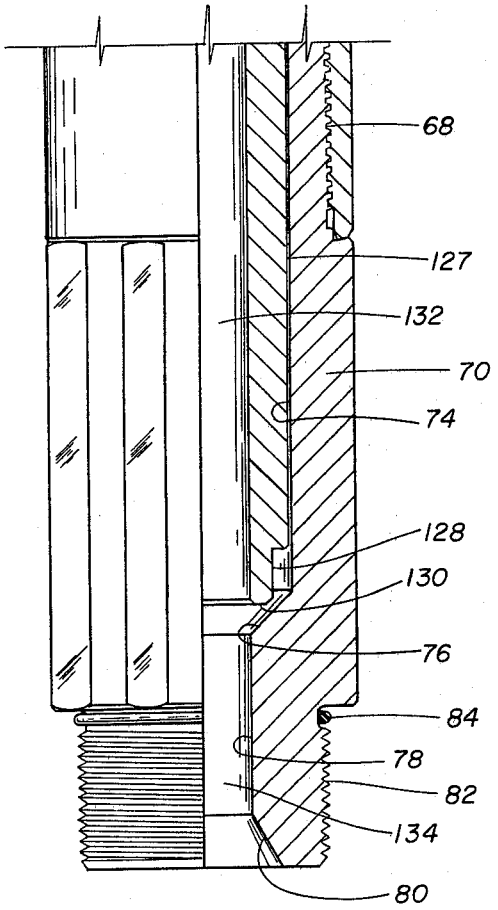
Figure 2A:
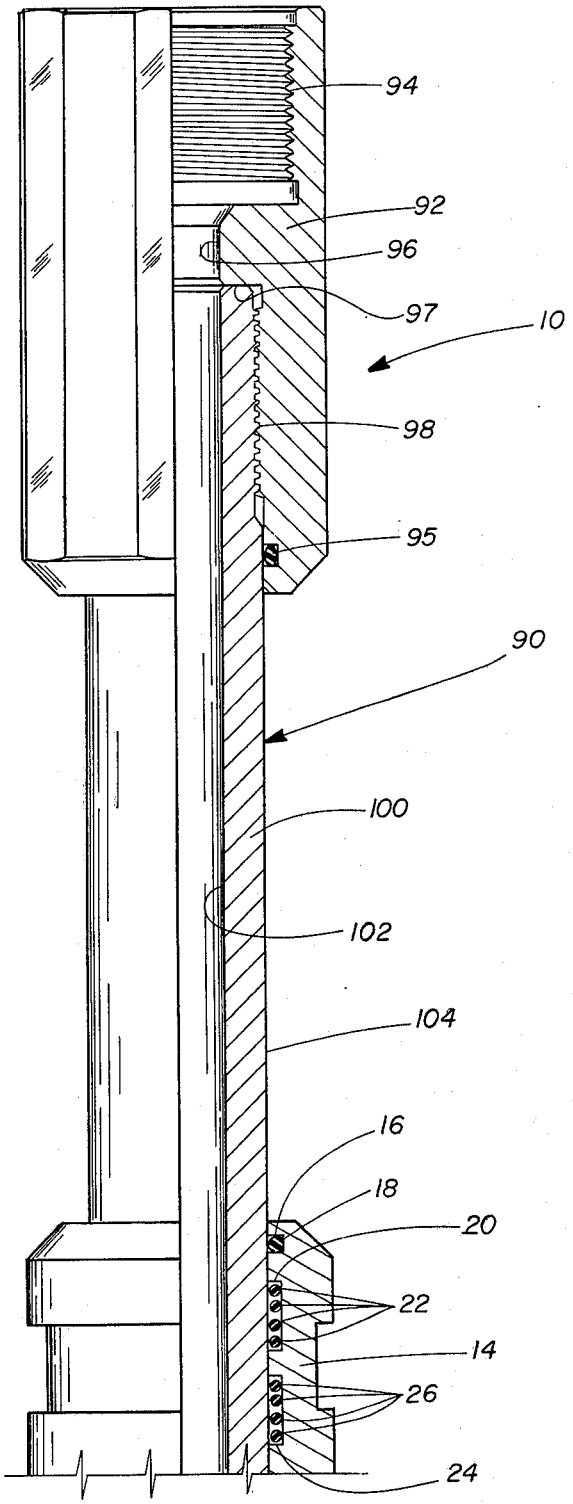
FIGS. 2A–2E, a half-section elevation, depicts the hydraulic well jar of the present invention in its fully extended, or jarring, position.
Figure 2B:
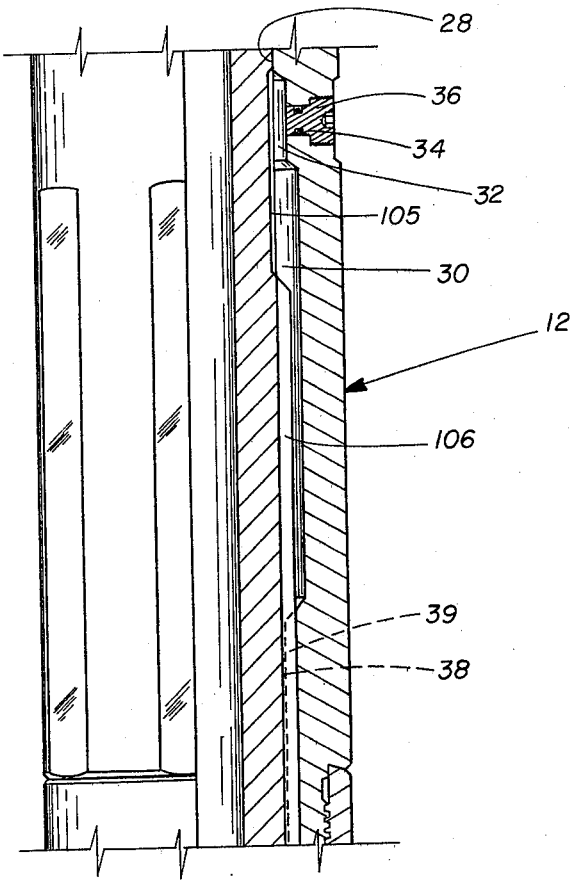
Figure 2C:
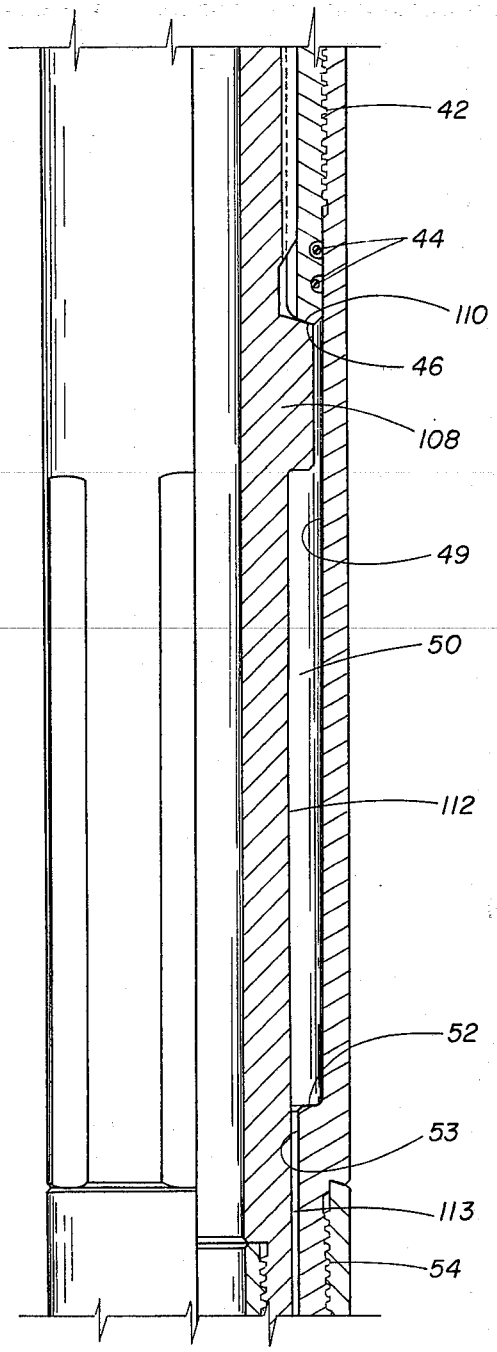
Figure 2D:
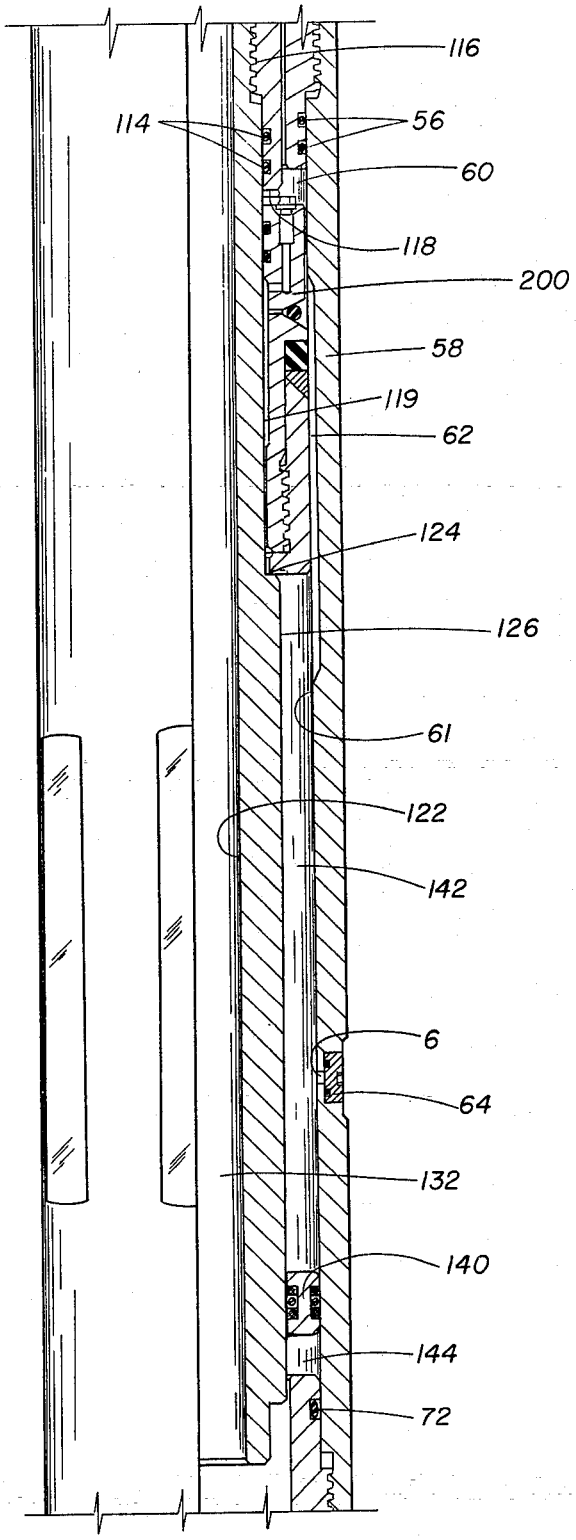
Figure 2E:
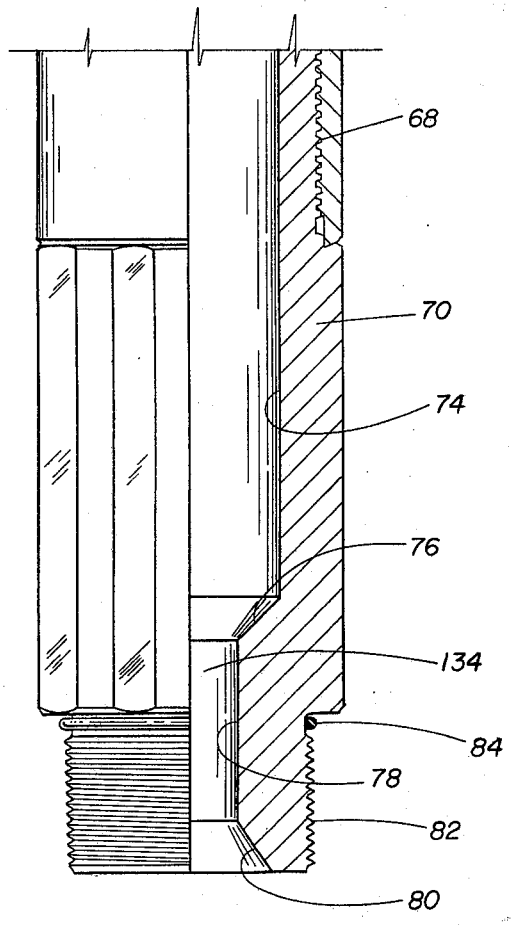

Equalizing piston 140, shown in more detail in FIG. 3 then in FIG. 1D, possesses O-rings 154 and 160, bracketed by teflon-filled backup rings 150 and 152, and 156 and 158, respectively. Such backup rings provide an enhanced seal and greater O-ring longevity for equalizing piston 140.

As noted previously, the area between outer case 12 and mandrel assembly is filled with hydraulic fluid. Upper reservoir chamber 30, intermediate reservoir chamber 60 and lower reservoir chamber 142 are in communication, the fixed volume of oil moving back and forth between the various chambers during operation of the tool. It should be understood that all of the chambers are of varying volume, due to movement of the mandrel assembly 12, but that the total volume of all the chambers and communicating passage is constant at a particular string pressure and well bore temperature.

OPERATION OF THE PREFERRED EMBODIMENT

Referring now to FIGS. 1A–1E, 2A–2E and 3 of the drawings, operation of jar 10 will be described. FIGS. 1A–1E portray the jar of the present invention in its retracted position, that is to say before the jarring operation commences. FIGS. 2A–2E portray the jar 10 at the moment the jarring force is generated.

By way of illustration of the operation of the jar of the present invention, it is assumed that a portion of the string below jar 10 has become lodged in the well bore. To effect a jar to the string, and free it, the operator at the surface generates an upward load on the string, for example, of 40,000 pounds. This force is transmitted through the pipe of the string to top coupling 92 through its threaded connection at 94 with the string above it.

The tensile force operating on top coupling 92 pulls mandrel assembly 90 upward relative to outer case 12. Upward movement of mandrel assembly 90 is impeded due to the fact that the hydraulic fluid in upper reservoir chamber 30 and intermediate reservoir chamber 60 cannot flow to lower reservoir chamber 142 except through vortex jets 204, one of which is shown in FIG. 3. Fluid is prevented from bypassing metering assembly 200 on the mandrel side by O-rings 218, and through the metering assembly itself by the pressure of fluid acting through annular passage 217, forcing O-ring 216 into sealing engagement with the mouth of radial passage 212, and on the case side by seal 228, which is backed up and prevented from extruding between metering assembly 200 and surface 61 of lower case 58 by metallic backup ring 226. Therefore, fluid enters vortex jets 204 through apertures 244 in screen retainer 242, travels through longitudinal passage 206, to radial passage 208, thence to annular passage 210, restricted annular passage 211, into the annular gap between impact mandrel upper surface 119 and inner surface 223 of seal retainer 220 and through radial channel 225 to lower reservoir chamber 142. Thus, as intermediate chamber 60 decreases in volume through the upward movement of metering assembly 200, and upper chamber 30 decreases in volume as keys 106 enter it on the upstroke of mandrel assembly 90, lower reservoir chamber 142 expands to maintain the total volume of the system as a constant.

It should be noted at this time that ambient pressure in the string and temperature in the well bore are compensated for by the inclusion of equalizing piston 140 in jar 10. Equalizing piston 140 slides on lower mandrel 120 in sealing engagement therewith and with inner diameter 61 of lower case 58. Equalizing chamber 144 on the lower side of piston 140 is acted upon by the ambient string pressure through annular passage 127, which communicates with bores 132 and 134. The jar 10 as a whole is exposed to the ambient temperature at that depth in the well bore. Increased pressure will naturally tend to move equalizing piston 140 upwardly, compressing the fluid in jar 10. Increasing temperature will tend to expand the fluid in jar 10, moving equalizing piston 140 in a downward direction. As the string moves through the well, varying temperatures and pressures will move equalizing piston back and forth, always maintaining the fluid on both sides of metering assembly 200 at the same pressure, to ensure that a pressure buildup on one side of the metering assembly 200 or the other, which buildup could diminish the jarring effect of the tool, or possibly rupture a seal. An increase in pressure in lower reservoir chamber 142 will result in a bleedoff to intermediate chamber 60 through radial passage 212, forcing O-ring 216 away from the mouth thereof. While the viscosity of the fluid in jar 10 will vary somewhat with temperature, the presence of equalizing piston pressurizing the fluid will ensure substantial uniformity of jarring force, and there is no substantial variation of time from initiation of an upward pull on mandrel assembly 90 to time of impact of hammer element 110 on anvil element 46 due to the fact that metering jets 204 are viscosity compensated.

As mandrel assembly 90 is pulled upwardly, its movement is highly restricted initially by the fluid flow through vortex jets 204. This restriction of movement results in a pressure buildup of fluid in chambers 30 and 60 which resists mandrel movement. As the trailing edge of metallic backup ring 226 passes the lowest end of bypass splines 62, fluid begins to bypass the metering assembly. As upward movement continues and metering assembly 200 becomes more centered longitudinally with respect to bypass splines 62, the fluid is suddenly dumped from chamber 60 to chamber 142, and mandrel assembly 90 experiences a sudden, forceful upward thrust. This thrust is abruptly arrested by the impact of hammer face 110 of hammer element 108 on anvil element 46. The jarring force resulting from this impact is transmitted through the jar 10 to the rest of the string.

Rotation of the string in which jar 10 is placed is sometimes necessary to operate other tools, such as packers or safety joints, below jar 10.

During the entire mandrel stroke, keys 106 engage splines 40, thus preventing rotational movement of mandrel assembly 90 with respect to outer case 12 and transmitting of rotational movement in the string to tools placed below jar 10. Rotational movement between mandrel assembly 90 and outer case 12 is also extremely destructive to O-ring and other seals, and may also result in stresses that damage metal parts in shear. Therefore, the interaction of keys 106 with splines 40 also contributes to tool life and efficiency by permitting only relative longitudinal motion within jar 10.

To reset the jar, upward loading is removed at the surface, and the weight of the string will force the mandrel assembly 90 in a downward direction. Fluid returns to intermediate reservoir chamber 60 from lower reservoir chamber 142 through radial channel 225, restricted annular passage 211, annular passage 210, radial passage 212, annular v-notch 214 by expanding elastomeric O-ring 216 outwardly, and annular passage 217. As mandrel assembly 90 reaches the lowermost extent of its travel, an upward pulling force initiates the next jarring cycle. Jarring is continued until the string is freed in the well bore.

Several advantageous features of jar 10 of the present invention should be noted in detail. The bypass splines 62, by permitting the maintenance of a relatively constant inner diameter 61 of lower case 58 even in the bypass area, increases the life of seal 228 by maintaining inward pressure on it throughout both the upstroke and downstroke of mandrel assembly 90. The increased bore bypasses of the prior art, on the other hand, gave no inward support whatsoever in the bypass area, thus subjecting the unsupported seal to the deleterious force of the bypassing fluid on the upstroke, and squeezing the unsupported seal unevenly as it was compressed into the main bore on the downstroke. Another advantage of the present invention over the prior art rests in the use of the backup ring 226 to prevent extrusion of seal 228 on the mandrel upstroke. When pressure is applied to seal 228 on the upstroke, backup ring 226 is forced against beveled surface 224 on seal retainer 220, which expands backup ring 226 against bore wall 61, creating an area of zero clearance behind the seal 228. The backup ring 226 also forms a partial seal which protects seal 228 from erosion as it passes the bypass splines. Furthermore, the presence of the zero clearace backup ring provides some sealing even in the event of partial or total destruction of seal 228. Therefore, while optimum force may not be obtained in the event of seal destruction, the jar is still operative. Furthermore, even if there is leakage of fluid from the jar, the resistance of backup ring 226 to mandrel movement will result in some jarring force being generated.

Another advantage of the present invention over the prior art resides in the mounting procedure for the screens for the vortex jets. Belleville spring 240, by exerting a bias against screen retainer 242 which in turn covers the mouth of vortex jet 204, results in an advantageous mounting system for the entire metering assembly 200, as impact mandrel 100 and lower mandrel 120 are threaded together. As a spring force is always being exerted to maintain the metering assembly 200 in place without the necessity for any bonding or adhesive to secure the screens, jets or any other part of the metering assembly.

It is thus apparent that the hydraulic jar of the present invention possesses many new and advantageous features over the prior art. While a preferred embodiment has been disclosed, it will be obvious to those of ordinary skill in the art that modifications, additions and deletions may be made. For example, the number of splines, keys and bypass splines may be varied. The equalizing piston could be placed at the upper end of the jar, with a passage exposing one side of the piston to ambient pressure. Placement of the hammer and anvil elements may be varied. These and other modifications may be made without departing from the spirit and scope of the claimed invention.

I claim:

1. A hydraylic well jar, comprising:

a case;

a mandrel longitudinally slidably disposed within said case;

chamber means containing a hydraulic fluid, said chamber means being defined by said case and said mandrel;

fluid bypass means comprising longitudinally oriented splines in the interior of said case;

fluid metering means on said mandrel; and slidable seal means about said fluid metering means, said seal means having an elastomeric seal backed by a metal ring.

2. The well jar of claim 1, wherein said splines are of substantially semicircular cross-section.

3. The well jar of claim 1, wherein said elastomeric seal is of substantially rectangular cross-section and is abutted by said metal backing ring of substantially triangular cross-section.

4. The well jar of claim 3, wherein one face of said backing ring is oriented obliquely to the longitudinal extent of said well jar.

5. The well jar of claim 4, wherein said seal ring and said backing ring are contained in an annular recess in said fluid metering means, said annular recess having a substantially laterally extending side wall adjacent said seal ring, and a substantially outwardly beveled side wall adjacent said backing ring.

6. The well jar of claim 5 wherein, when said mandrel is being slidably extended with respect to said case, said backing ring is forced by said hydraulic fluid into a zero clearance engagement with the interior of said case.

7. A hydraulic jar, comprising:

a case having an axial bore therethrough, said axial bore having a portion of substantially constant diameter;

a mandrel axially slidably disposed in said bore;

chamber means defined by said case and said mandrel, said chamber means containing a hydraulic fluid;

fluid metering means attached to said mandrel, said fluid metering means having at least one vortex jet;

slidable seal means disposed between said fluid metering means and said case, said fluid metering means having an elastomeric seal backed by a metal ring; and substantially longitudinally extending bypass splines opening on said bore portion of substantially constant diameter in said case.

8. The hydraulic jar of claim 7, wherein said bypass splines are of substantially semicircular cross-section.

9. The hydraulic jar of claim 7, wherein said elastomeric seal is of substantially rectangular cross-section, said metal ring is of substantially triangular cross-section, and a radially extending face of said metal ring abuts a radially extending wall of said seal.

10. The hydraulic jar of claim 9, wherein said elastomeric seal and said metal ring are disposed in an annular recess on said metering means, said annular recess having a first radially extending wall, and a second outwardly beveled wall, said elastomeric seal abutting said radially extending wall and said metal ring abutting said beveled wall.

11. The hydraulic jar of claim 10, wherein said metal ring is forced into substantially zero clearance engagement with the bore wall of said case when said mandrel is being axially extended with respect to said case.

12. The hydraulic jar of claim 7, wherein said fluid metering means is mechanically mounted on said mandrel, said fluid metering means being fixedly held by a biasing force on said mandrel.

13. The hydraulic jar of claim 12, wherein said biasing force is substantially axial and is provided by a belleville spring.

14. The hydraulic jar of claim 13, further including screen means disposed at the mouth of said at least one vortex jet, said screen means being biased against said vortex jet by said belleville spring.

15. In a hydraulic well jar having a mandrel axially slidably disposed within a case defining a chamber thereabout, a hydraulic fluid in said case and fluid metering means on said mandrel dividing said chamber, the improvement comprising:

slidable seal means between said fluid metering means and the interior of said case, said seal means having an elastomeric seal of substantially rectangular cross-section abutting a metal ring of substantially triangular cross-section, said seal and said ring being disposed in an annular recess in said fluid metering means, said annular recess possessing a radially extending leading wall abutting said elastomeric seal, and an outwardly beveled trailing wall abutting the trailing face of said metal ring.

16. In a hydraulic well jar having a mandrel axially slidably disposed within a case defining a chamber thereabout, a hydraulic fluid in said case and fluid metering means on said mandrel dividing said chamber, the improvement comprising:

at least one substantially longitudinally extending fluid bypass spline on the bore wall of said case, whereby, when said metering means is substantially adjacent said at least one spline, said hydraulic fluid may pass from one portion of said chamber to the other without passing through said metering means; and slidable seal means between said fluid metering means and the interior of said case, said seal means having an elastomeric seal of substantially rectangular cross-section abutting a metal ring of substantially triangular cross-section wherein one face of said metal ring is oriented obliquely to the longitudinal extent of said well jar, said seal and said ring being disposed in an annular recess in said fluid metering means, said elastomeric seal and said metal ring being constrained in said annular recess by the bore wall of said case during the extent of travel of said axially slidably disposed mandrel.

17. A hydraulic well jar, comprising:

a case;

a mandrel longitudinally slidably disposed within said case;

chamber means containing a hydraulic fluid, said chamber means being defined by said case and said mandrel;

longitudinal fluid bypass means in said case;

fluid metering means on said mandrel; and slidable seal means about said fluid metering means, said seal means having an elastomeric seal of substantially rectangular cross-section, which seal is abutted by a metal backing ring of substantially triangular cross-section, one face of said metal backing ring being oriented obliquely to the longitudinal extent of said well jar.

18. The well jar of claim 17, wherein said seal ring and said backing ring are contained in an annular recess in said fluid metering means, said annular recess having a substantially laterally extending side wall adjacent said seal ring, and a substantially outwardly beveled side wall adjacent said backing ring.

19. The well jar of claim 18 wherein, when said mandrel is being slidably extended with respect to said case, said backing ring is forced by said hydraulic fluid into a zero clearance engagement with the interior of said case.

* * * * *

UNITED STATES PATENT AND TRADEMARK OFFICE

CERTIFICATE OF CORRECTION

PATENT NO. : 4,346,770

DATED : August 31, 1982

INVENTOR(S) : Harold K. Beck

It is certified that error appears in the above-identified patent and that said Letters Patent is hereby corrected as shown below:

Column 3, line 64, after the word element delete the numeral "10" and insert --108 is adjacent annular shoulder 52 in upper case 48 when jar 110 is in its retracted position as shown in FIGURES 1A-1E. Below hammer element 108, outer mandrel surface 112--

Signed and Sealed this

*Twenty-third* Day of *November 1982*

[SEAL]

*Attest:*

GERALD J. MOSSINGHOFF

*Attesting Officer*

*Commissioner of Patents and Trademarks*